US012405040B2

(12) United States Patent
Gao et al.

(10) Patent No.: US 12,405,040 B2
(45) Date of Patent: Sep. 2, 2025

(54) COMPRESSOR AND HEAT EXCHANGE SYSTEM

(71) Applicant: GUANGDONG MEIZHI PRECISION-MANUFACTURING CO., LTD., Guangdong (CN)

(72) Inventors: Bin Gao, Guangdong (CN); Huaming Li, Guangdong (CN); Baowei Wang, Guangdong (CN)

(73) Assignee: GUANGDONG MEIZHI PRECISION-MANUFACTURING CO., LTD., Guang Dong (CN)

( * ) Notice: Subject to any disclaimer, the term of this patent is extended or adjusted under 35 U.S.C. 154(b) by 538 days.

(21) Appl. No.: 17/383,566

(22) Filed: Jul. 23, 2021

(65) Prior Publication Data

US 2021/0348814 A1 Nov. 11, 2021

Related U.S. Application Data

(63) Continuation of application No. PCT/CN2019/092524, filed on Jun. 24, 2019.

(51) Int. Cl.

| | |
|---|---|
| ***F25B 43/00*** | (2006.01) |
| ***F25B 13/00*** | (2006.01) |
| ***F25B 41/22*** | (2021.01) |

(52) U.S. Cl.

CPC ..... *F25B 43/006* (2013.01); *F25B 13/00* (2013.01); *F25B 41/22* (2021.01)

(58) Field of Classification Search

CPC ..... F25B 43/006; F25B 13/00; F25B 41/22; F25B 41/24; F04C 29/12

See application file for complete search history.

(56) References Cited

U.S. PATENT DOCUMENTS

2006/0010899 A1 1/2006 Lifson et al.
2006/0179867 A1 8/2006 Ha et al.
(Continued)

FOREIGN PATENT DOCUMENTS

CN 103016347 A 4/2013
CN 104929931 A 9/2015
(Continued)

OTHER PUBLICATIONS

International Search Report dated Mar. 27, 2020 received in International Application No. PCT/CN2019/092524 together with an English language translation.
Notice of the First Examination Opinion dated Sep. 2, 2021 received in Chinese Patent Application No. CN 201910548641.3 together with an English language translation.
Examination Report No. 1 dated Sep. 27, 2022 received in Australian Patent Application No. AU 2019454057.
(Continued)

*Primary Examiner* — Abby J Flynn
*Assistant Examiner* — Matthew John Moscola
(74) *Attorney, Agent, or Firm* — SCULLY, SCOTT, MURPHY & PRESSER, P.C.

(57) ABSTRACT

A compressor and a heat exchange system are provided. The compressor has a sealed container and a liquid storage tank. An outlet end of the liquid storage tank is connected to an inlet end of the sealed container. An outlet end of the sealed container and an inlet end of the liquid storage tank are connected to an external heat exchange loop. A motor and a compression mechanism of the compressor are mounted in the sealed container. A first valve of the compressor is mounted at the outlet end of the sealed container and allows unidirectional communication from the sealed container to the external heat exchange loop. A second valve of the compressor is mounted at the inlet end of the liquid storage tank and allows unidirectional communication from the external heat exchange loop to the liquid storage tank.

12 Claims, 8 Drawing Sheets

(56) References Cited

U.S. PATENT DOCUMENTS

| | | | | |
|---|---|---|---|---|
| 2010/0212342 | A1* | 8/2010 | Jeong | F25B 41/00 700/275 |
| 2015/0176868 | A1* | 6/2015 | Kayano | F25B 1/10 62/324.6 |
| 2016/0231038 | A1* | 8/2016 | Ozu | F04C 18/356 |
| 2018/0180047 | A1* | 6/2018 | Ayub | H01F 7/06 |
| 2018/0224175 | A1* | 8/2018 | Crawford | F25B 49/02 |
| 2020/0141619 | A1* | 5/2020 | Wang | F25B 49/02 |
| 2020/0284476 | A1* | 9/2020 | Nishio | F25B 41/39 |
| 2021/0052106 | A1* | 2/2021 | McKay | F25B 29/003 |
| 2021/0140689 | A1* | 5/2021 | Hu | F04C 18/322 |
| 2021/0318046 | A1* | 10/2021 | Kikuchi | F25B 13/00 |
| 2021/0356185 | A1* | 11/2021 | Yang | F25B 49/02 |
| 2021/0364168 | A1* | 11/2021 | Lindoff | F24D 10/003 |
| 2022/0209701 | A1* | 6/2022 | Kubota | H02P 27/085 |

FOREIGN PATENT DOCUMENTS

| | | | |
|---|---|---|---|
| CN | 204921363 | U | 12/2015 |
| CN | 208365880 | U | 1/2019 |
| JP | 2013-068106 | A | 4/2013 |
| KR | 10-2018-0083646 | A | 7/2018 |
| WO | 2012/026200 | A1 | 3/2012 |

OTHER PUBLICATIONS

Second Office Action dated Apr. 2, 2022 received in Chinese Patent Application No. CN 201910548641.3 together with an English language translation.

* cited by examiner

COMPRESSOR AND HEAT EXCHANGE SYSTEM

CROSS-REFERENCE TO RELATED APPLICATIONS

The present application is a continuation application of PCT International Application No. PCT/CN2019/092524, filed on Jun. 24, 2019, the entire contents of which is incorporated herein by reference for all purposes. No new matter has been introduced.

FIELD

This application relates to the field of compressor manufacturing technology, and more particularly to a compressor and a heat exchange system having the compressor.

BACKGROUND

In refrigeration devices commonly used at present, a compressor stops operation after a previous loop, and a pressure difference between a suction side and an exhaust side of the compressor must reach a certain required range before the compressor can be restarted. Especially for a system-mounted rotary compressor with large refrigeration metering, the pressure difference must be a small value, such as within 1 kgf/cm$^2$; otherwise, the compressor cannot be started, and a quick restart function after shutdown cannot be realized.

In the related art, when the compressor is shut down, a refrigerant in a heat exchanger at a high-pressure side may quickly return to a low-pressure side through a gap between components of the compressor, thereby increasing the temperature and pressure in the heat exchanger at the low-pressure side. In this case, heat in the heat exchanger at the high-pressure side will be wasted and the refrigeration capacity in the heat exchanger at the low-pressure side will be lost, which is not conducive to operation efficiency of the refrigeration device. There is room for improvement.

SUMMARY

The present disclosure aims to solve at least one of the technical problems existing in the related art. To this end, according to an aspect of the present disclosure, a compressor is provided, which can quickly realize pressure balance between a high-pressure side and a low-pressure side of the compressor, and will not cause excessive waste of heat and refrigeration capacity.

The compressor according to certain embodiments of the present disclosure includes: a sealed container and a liquid storage tank, in which an outlet end of the liquid storage tank is connected to an inlet end of the sealed container, and an outlet end of the sealed container and an inlet end of the liquid storage tank are connected to an external heat exchange loop; a motor and a compression mechanism, both mounted in the sealed container; a first valve and a second valve, in which the first valve is mounted at the outlet end of the sealed container and allows unidirectional communication from the sealed container to the external heat exchange loop, and the second valve is mounted at the inlet end of the liquid storage tank and allows unidirectional communication from the external heat exchange loop to the liquid storage tank.

For the compressor according to the embodiments of the present disclosure, the first valve and the second valve are arranged at the inlet end and the outlet end of the compressor, respectively, and both the first valve and the second valve are in the closed state after the compressor stops working, so that the heat exchange medium realizes the pressure balance within the compressor, and it takes less time to reach the pressure balance, which can meet the requirement of rapid restart; moreover, the heat exchange medium in the external heat exchange loop cannot flow back, and the residual heat may be effectively utilized.

The present disclosure also proposes a heat exchange system.

The heat exchange system according to certain embodiments of the present disclosure includes: a first heat exchanger, a throttle valve, a second heat exchanger, and the compressor according to any one of the above embodiments. The first valve is mounted between an inlet end of the first heat exchanger and an outlet end of the sealed container and allows unidirectional communication from the sealed container to the first heat exchanger; the throttle valve is connected between an outlet end of the first heat exchanger and an inlet end of the second heat exchanger; and the second valve is mounted between an inlet end of the liquid storage tank and an outlet end of the second heat exchanger and allows unidirectional communication from the second heat exchanger to the liquid storage tank.

The heat exchange system and the compressor described above have the same or similar advantages over the related art.

Additional aspects and advantages of the present disclosure will be given in part in the following description, become apparent in part from the following description, or be learned from the practice of the present disclosure.

BRIEF DESCRIPTION OF THE DRAWINGS

The above and/or additional aspects and advantages of the present disclosure will become apparent and more readily appreciated from the following description of embodiments with reference to the drawings, in which.

Figure 1:
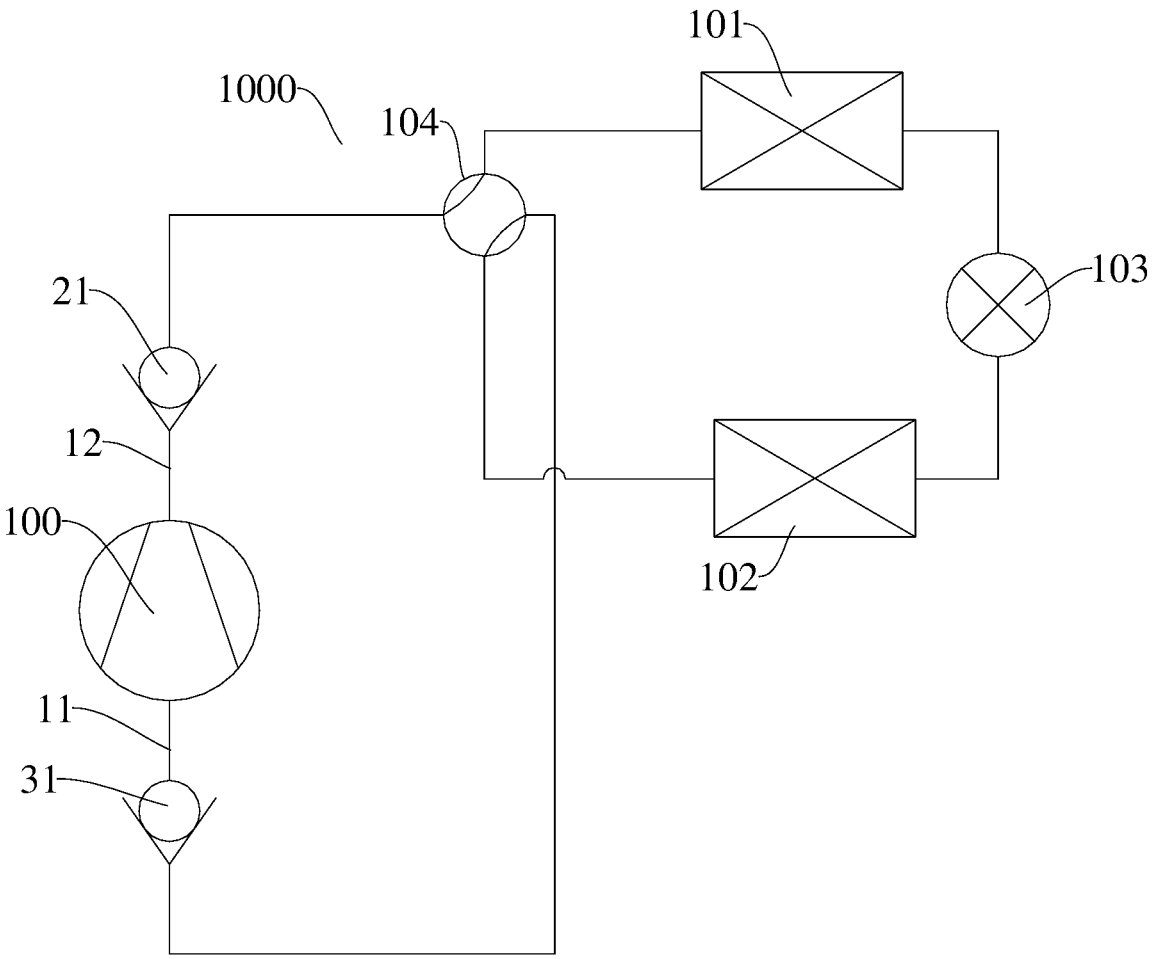
FIG. 1 is a schematic view of a heat exchange system and a compressor according to an embodiment of the present disclosure.

LISTING OF REFERENCE NUMERALS heat exchange system 1000,
compressor 100,
sealed container 1, intake pipe 11, exhaust pipe 12,
first valve 21, first valve core 22, first through hole 23, first valve body 24, first inlet 25, first outlet 26,
second valve 31, second valve core 32, second through hole 33, second valve body 34, second inlet 35, second outlet 36,
liquid storage tank 4,
first heat exchanger 101, second heat exchanger 102, throttle valve 103, reversing valve 104.

DETAILED DESCRIPTION OF EMBODIMENTS

Embodiments of the present disclosure will be described in detail below, and examples of the embodiments will be shown in the drawings. The same or similar elements and the elements having same or similar functions are denoted by like reference numerals throughout the descriptions. The following embodiments described with reference to the drawings are exemplary and are used to explain the present disclosure rather than limit the present disclosure.

A compressor 100 according to certain embodiments of the present disclosure will be described below with reference to FIGS. 1-7. A one-way valve is arranged at each of an inlet end and an outlet end of the compressor 100, which can ensure that the compressor 100 is in communication with an external heat exchange loop when the compressor 100 is working, to realize circulation of a heat exchange medium, and that the compressor 100 is disconnected from the external heat exchange loop when the compressor 100 stops working. The heat exchange medium in the compressor 100 only diffuses within the compressor 100. Therefore, when the compressor 100 stops working, pressure balance between a high-pressure side and a low-pressure side of the compressor 100 can be quickly realized, which is advantageous for the compressor 100 to restart quickly after shutdown.

As shown in FIGS. 1-5, the compressor 100 according to embodiments of the present disclosure includes: a sealed container 1, a liquid storage tank 4, a motor 105, a compression mechanism 106, a first valve 21, and a second valve 31.

Figure 3:
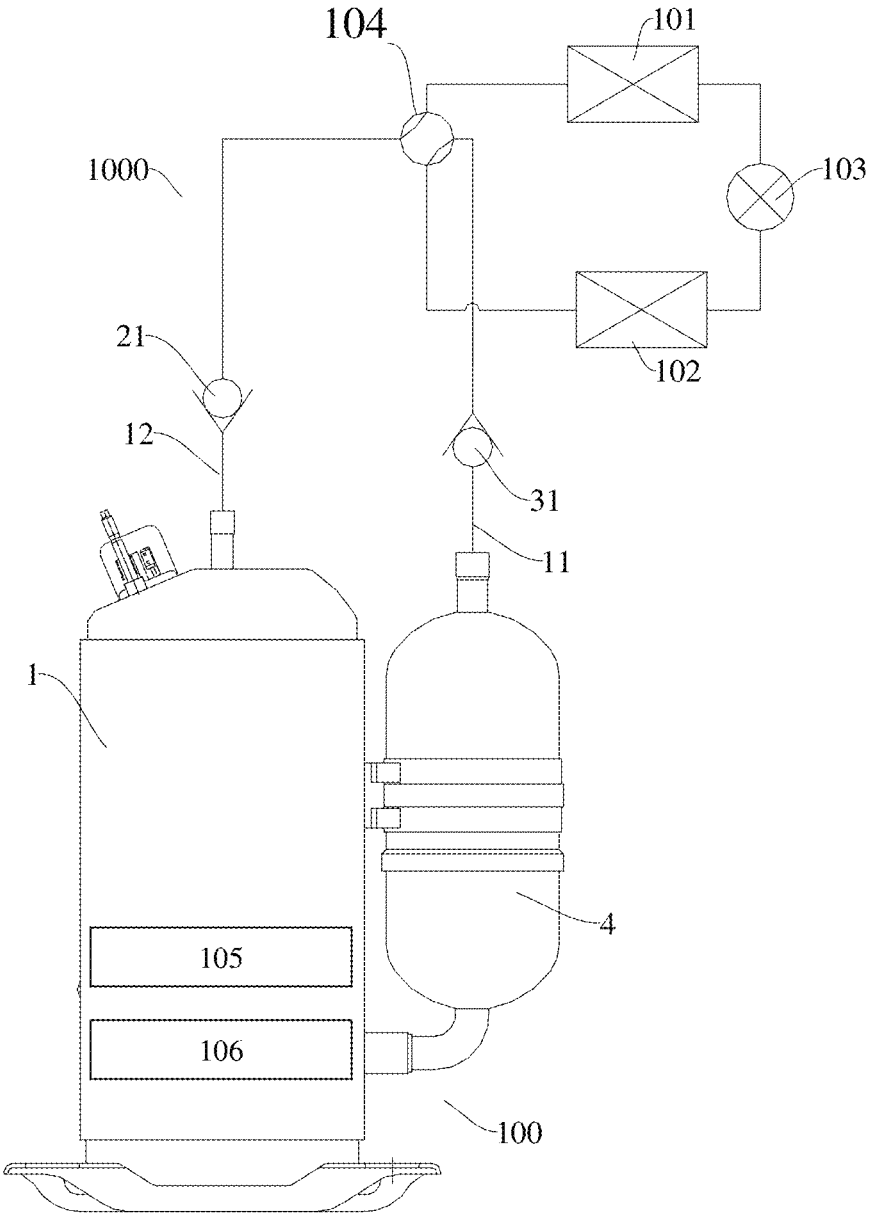
FIG. 3 is a schematic view of a heat exchange system and a compressor according to still another embodiment of the present disclosure.
Figure 4:
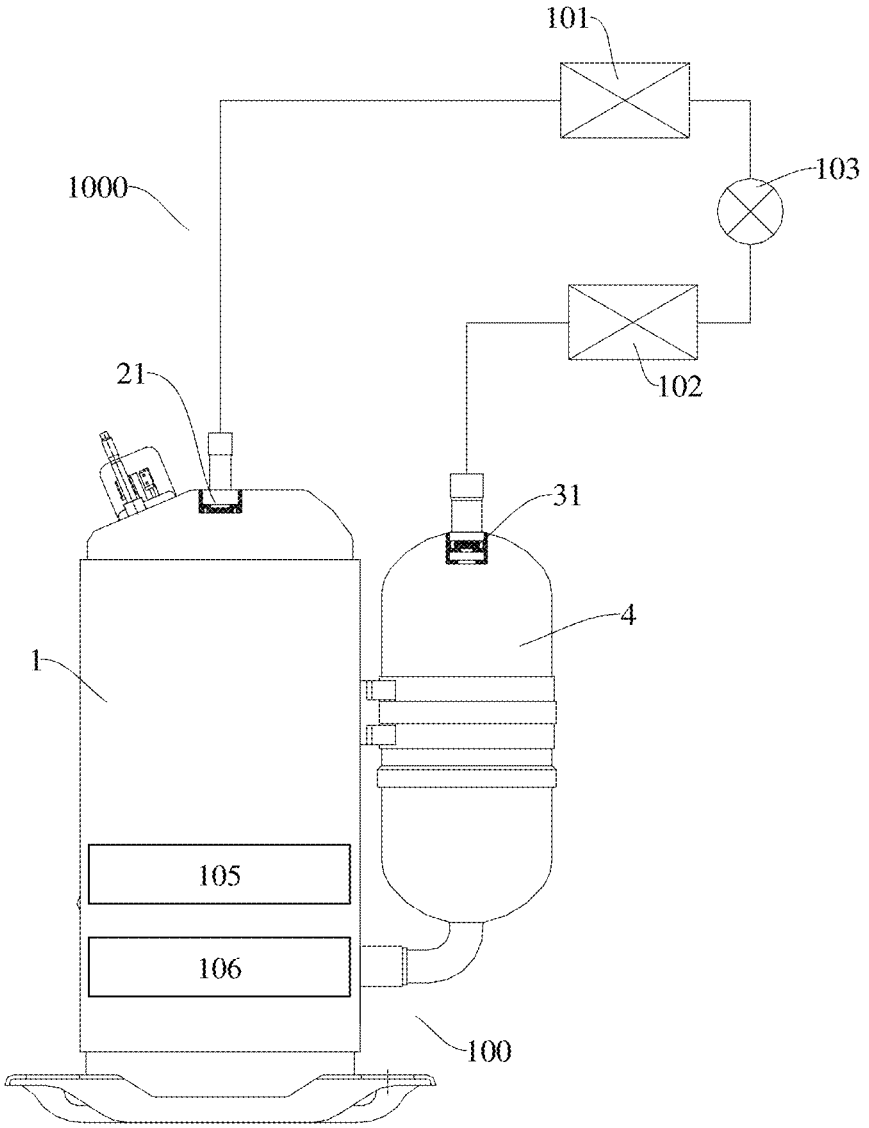
FIG. 4 is a schematic view of a heat exchange system and a compressor according to yet another embodiment of the present disclosure.
Figure 5:
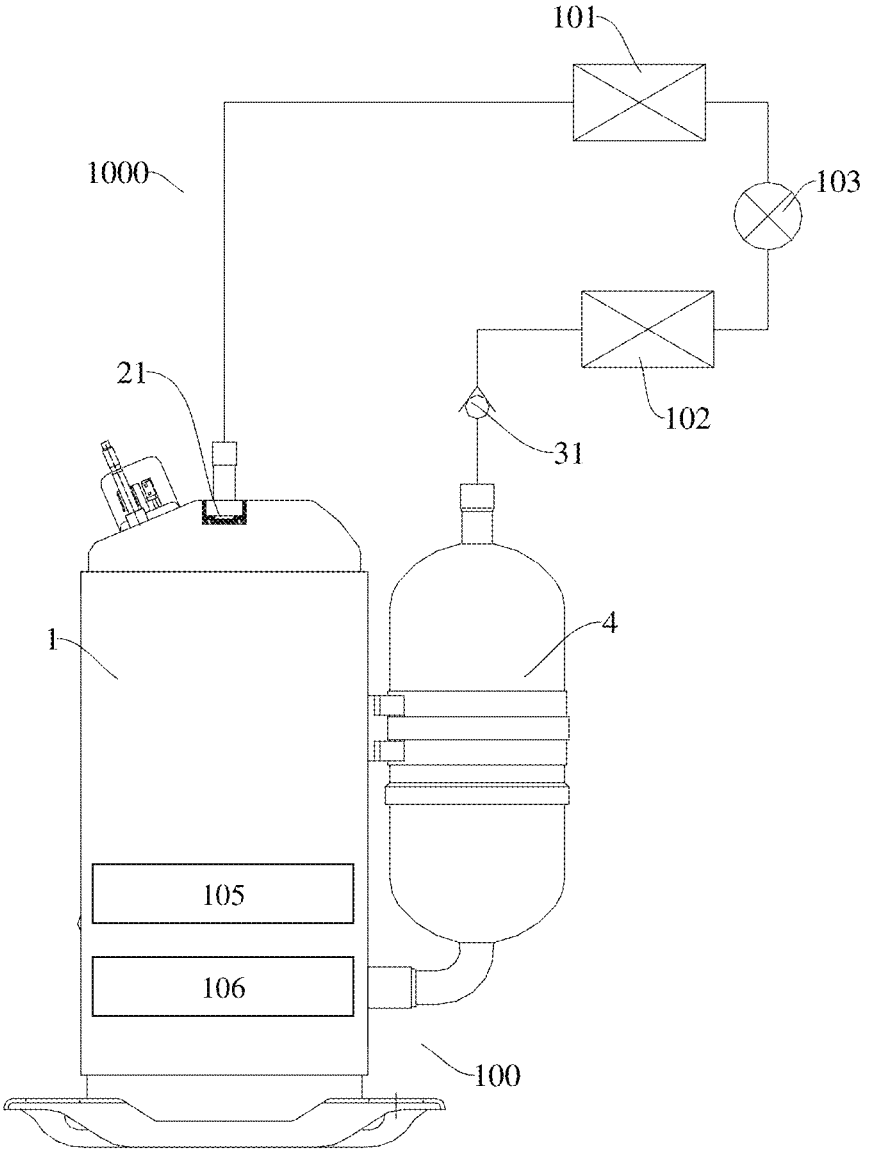
FIG. 5 is a schematic view of a heat exchange system and a compressor according to yet another embodiment of the present disclosure.

As shown in FIGS. 3-5, an outlet end of the liquid storage tank 4 is connected to an inlet end of the sealed container 1. The sealed container 1 has a first inner cavity, and the liquid storage tank 4 has a second inner cavity. Due to the existence of an internal fitting clearance of the compression mechanism 106, leakage may occur between the first inner cavity and the second inner cavity under a pressure difference, that is, the heat exchange medium may circulate between the first inner cavity and the second inner cavity. As a result, the heat exchange medium in the liquid storage tank 4 may flow into the sealed container 1.

As shown in FIGS. 3, 4 and 5, an outlet end of the sealed container 1 and an inlet end of the liquid storage tank 4 are connected to an external heat exchange loop. The motor 105 and the compression mechanism 106 are mounted in the sealed container 1. The compression mechanism 106 can compress the heat exchange medium entering the sealed container 1 and then discharge it into the first inner cavity of the sealed container 1. Both the motor 105 and the compression mechanism 106 are fixedly connected to an inner wall of the sealed container 1, so that the motor 105 and the compression mechanism 106 are stably mounted in the sealed container 1, ensuring stable operation of the compressor 100.

In this way, the high-pressure heat exchange medium compressed by the compression mechanism 106 is discharged into the first inner cavity; the high-pressure heat exchange medium in the first inner cavity flows from the outlet end of the sealed container 1 to the external heat exchange loop, then flows back to the inlet end of the liquid storage tank 4, and enters the second inner cavity after heat exchange with the external environment in the external heat exchange loop. The heat exchange medium that flows back has a relatively low pressure, that is, the pressure of the heat exchange medium in the second inner cavity is lower, and the heat exchange medium flows from the second inner cavity to the first inner cavity to be compressed again. Thus, the heat exchange medium circulates between the compressor 100 and the external heat exchange loop and fulfills its heat exchange function.

As shown in FIGS. 3, 4 and 5, the first valve 21 is mounted at the outlet end of the sealed container 1, and the first valve 21 allows unidirectional communication from the sealed container 1 to the external heat exchange loop. That is, the heat exchange medium in the sealed container 1 can flow from the outlet end of the sealed container 1 to the external heat exchange loop unidirectionally, and the heat exchange medium in the external heat exchange loop cannot flow into the sealed container 1 from the outlet end of the sealed container 1.

As shown in FIGS. 3, 4 and 5, the second valve 31 is mounted at the inlet end of the liquid storage tank 4, and the second valve 31 allows unidirectional communication from the external heat exchange loop to the liquid storage tank 4. That is, the heat exchange medium in the external heat exchange loop can flow from the inlet end of the liquid storage tank 4 into the liquid storage tank 4 unidirectionally, and the heat exchange medium in the liquid storage tank 4 cannot flow to the external heat exchange loop.

Figure 2:
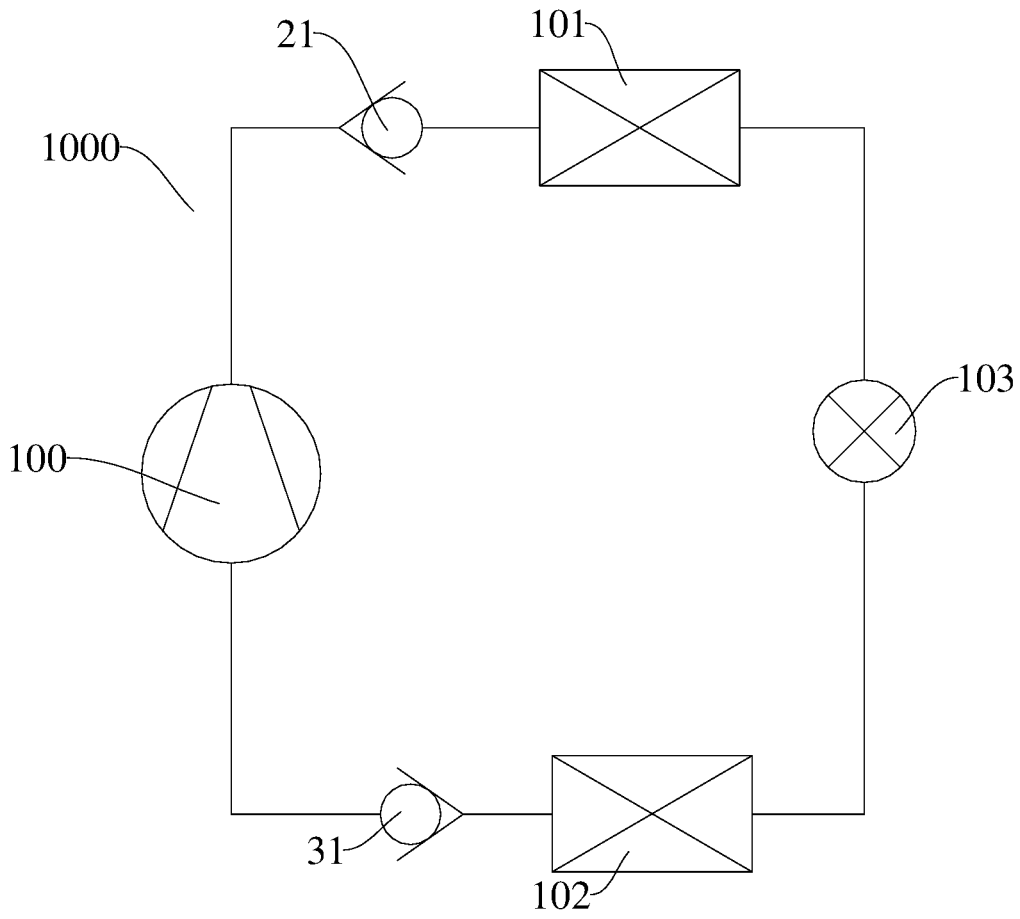
FIG. 2 is a schematic view of a heat exchange system and a compressor according to another embodiment of the present disclosure.

Thus, as shown in FIGS. 1 and 2, the first valve 21 is arranged at the outlet end of the compressor 100, and the second valve 31 is arranged at the inlet end of the compressor 100. When the compressor 100 operates normally, the first valve 21 and the second valve 31 are each in a unidirectionally unblocked state due to the pressure generated by the compressor 100. The high-pressure heat exchange medium in the compressor 100 flows from the outlet end to the external heat exchange loop, and the external heat exchange loop flows from the inlet end of the compressor 100 into the compressor 100.

When the compressor 100 stops working, the first valve 21 and the second valve 31 are each in a closed state, and no medium exchange occurs between the compressor 100 and the external heat exchange loop, that is, the heat exchange medium in the compressor 100 only flows within the compressor. Due to a relatively small space inside the compressor 100, the high-pressure heat exchange medium in the sealed container 1 gradually flows to the liquid storage tank 4, so that the pressure in the sealed container 1 gradually decreases, and at the same time the pressure in the liquid storage tank 4 gradually increases, thereby realizing the pressure balance inside the compressor 100. Moreover, due to the small space in the compressor 100, a final balance pressure inside the compressor 100 is relatively high, and it takes less time to reach the balance, which can meet a requirement of rapid restart.

Meanwhile, since both the first valve 21 and the second valve 31 are closed, the heat exchange medium in the external heat exchange loop may still utilize remaining heat, thereby improving overall efficiency of a heat exchange system 1000.

For the compressor 100 according to the embodiments of the present disclosure, the first valve 21 and the second valve 31 are arranged at the inlet end and the outlet end of the compressor 100, respectively. Both the first valve 21 and the second valve 31 are in the closed state after the compressor 100 stops working. As a result, the heat exchange medium realizes the pressure balance within the compressor 100, and it takes less time to reach the pressure balance, which can meet the requirement of a rapid restart operation. Moreover, the heat exchange medium in the external heat exchange loop cannot flow back, and the residual heat may be effectively utilized.

According to another aspect of the present disclosure, the heat exchange system 1000 is also provided.

The heat exchange system 1000 according to certain embodiments of the present disclosure includes: a first heat exchanger 101, a throttle valve 103, a second heat exchanger 102, and the compressor 100 as described above.

The compressor 100 according to various embodiments of the present disclosure will be described in detail below with reference to FIGS. 1-7.

The first embodiment is illustrated in FIG. 1.

The heat exchange system 1000 includes: a first heat exchanger 101, a throttle valve 103, a second heat exchanger 102, and a compressor 100. The compressor 100, the first heat exchanger 101, the throttle valve 103 and the second heat exchanger 102 are connected successively. As shown in FIG. 1, an outlet end of the compressor 100 is connected to an inlet end of the first heat exchanger 101; an outlet end of the first heat exchanger 101 is connected to an inlet end of the throttle valve 103; an outlet end of the throttle valve 103 is connected to an inlet end of the second heat exchanger 102, that is, the throttle valve 103 is connected between the first heat exchanger 101 and the second heat exchanger 102; and an outlet end of the second heat exchanger 102 is connected to an inlet end of the compressor 100.

Thus, as shown in FIG. 1, various components of the heat exchange system 1000 are connected successively to form a closed circulation loop, and a heat exchange medium circulates in the heat exchange system 1000. The heat exchange medium is compressed into a high-pressure heat exchange medium in the compressor 100, passes through the first heat exchanger 101, the throttle valve 103 and the second heat exchanger 102 successively, and exchanges heat with the external environment in the first heat exchanger 101 and the second heat exchanger 102 to realize heating and refrigerating functions.

As shown in FIG. 1, the first valve 21 is mounted between the inlet end of the first heat exchanger 101 and the outlet end of the compressor 100, and the first valve 21 allows unidirectional communication from the compressor 100 to the first heat exchanger 101. As a result, the heat exchange medium in the compressor 100 can flow into the first heat exchanger 101, and the heat exchange medium in the first heat exchanger 101 cannot flow from the first heat exchanger 101 back into the compressor 100.

As shown in FIG. 1, the second valve 31 is mounted between the inlet end of the compressor 100 and the outlet end of the second heat exchanger 102, and the second valve 31 allows unidirectional communication from the second heat exchanger 102 to the compressor 100. As a result, the heat exchange medium in the second heat exchanger 102 can flow into the compressor 100, and the heat exchange medium in the compressor 100 cannot flow from the compressor 100 back into the second heat exchanger 102.

Moreover, when the compressor 100 stops working, the first valve 21 and the second valve 31 are each in a closed state, and the compressor 100 does not exchange the medium with the first heat exchanger 101 and the second heat exchanger 102, that is, the heat exchange medium in the compressor 100 only flows within the compressor. Due to a relatively small space inside the compressor 100, the heat exchange medium in the compressor 100 flows from its high-pressure side (the outlet end) to its low-pressure side (the inlet end), to reduce a pressure difference of the compressor 100 gradually, realize pressure balance inside the compressor 100, and meet a requirement that the pressure difference is less than 1 $kgf/cm^2$ when the compressor 100 starts. Moreover, due to the small space in the compressor 100, a final balance pressure inside the compressor 100 is relatively high, and it takes less time to reach the balance, which may allow for rapid restart.

Meanwhile, since both the first valve 21 and the second valve 31 are closed, the heat exchange medium in the first heat exchanger 101 and the second heat exchanger 102 may still utilize the remaining heat or refrigeration capacity to realize corresponding heating or refrigerating functions, thereby improving overall efficiency of the heat exchange system 1000. As shown in FIG. 1, the first valve 21 and the second valve 31 are both one-way valves. Switch valves may also be used to realize opening and closing functions mentioned above, that is, the first valve and/or the second valve are switch valves. In other words, both the first valve and the second valve may be switch valves, or one of the first valve and the second valve may be a switch valve. Moreover, the switch valve is opened when the compressor starts, and the switch valve is closed when the compressor is shut down. The specific structures of the first valve 21 and the second valve 31 can be flexibly selected.

As shown in FIG. 1, an exhaust pipe 12 is arranged at the outlet end of the compressor 100, and used to be connected to an external heat exchange loop. As shown in FIG. 1, the exhaust pipe 12 is connected to the first heat exchanger 101, and the first valve 21 is mounted at the exhaust pipe 12. In this way, the heat exchange medium flows from the compressor 100 to the first heat exchanger 101 unidirectionally in the exhaust pipe 12.

As shown in FIG. 1, an intake pipe 11 is arranged at the inlet end of the liquid storage tank 4 and used to be connected to the external heat exchange loop. As shown in FIG. 1, the intake pipe 11 is connected to the second heat exchanger 102, and the second valve 31 is mounted at the intake pipe 11. In this way, the heat exchange medium flows from the second heat exchanger 102 to the compressor 100 unidirectionally in the intake pipe 11.

Moreover, as shown in FIG. 1, the heat exchange system 1000 also includes: a reversing valve 104.

As shown in FIG. 1, the reversing valve 104 has a first valve port, a second valve port, a third valve port, and a fourth valve port, that is, the reversing valve 104 is a four-way valve. The first valve port is connected to the outlet end of the compressor 100; the second valve port is connected to the inlet end of the first heat exchanger 101; the third valve port is connected to the outlet end of the second heat exchanger 102; and the fourth valve port is connected to the inlet end of the compressor 100.

The first valve port is in communication with one of the second valve port and the third valve port, and the fourth valve port is in communication with the other of the second valve port and the third valve port. As a result, when the first valve port, the second valve port, the third valve port and the fourth valve port are in different communication states, the heat exchange medium of the heat exchange system 1000 circulates along different paths.

As shown in FIG. 1, when the first valve port is in communication with the second valve port and the third valve port is in communication with the fourth valve port, the heat exchange medium flows to the first valve port of the reversing valve 104 after being pressurized in the compressor 100, and since the first valve port is in communication with the second valve port, the heat exchange medium is discharged from the second valve port and flows to the first heat exchanger 101 (a high-pressure side heat exchanger). The heat exchange medium flows out after exchanging heat with an external medium in the first heat exchanger 101, and flows to the second heat exchanger 102. The throttle valve 103 is arranged between the first heat exchanger 101 and the second heat exchanger 102, and the flow rate of the heat exchange medium between the first heat exchanger 101 and the second heat exchanger 102 may be adjusted by controlling the throttle valve 103. The heat exchange medium exchanges heat with an external medium again in the second heat exchanger 102 (a low-pressure side heat exchanger). The heat exchange medium flows to the third valve port of the reversing valve 104 after flowing out of the second heat exchanger 102, and since the third valve port is in communication with the fourth valve port, the heat exchange medium flows from the fourth valve port to a suction side of the compressor 100, and then flows into the compressor 100, to proceed with the next cycle.

When the first valve port is in communication with the third valve port and the second valve port is in communication with the fourth valve port, the heat exchange medium passes through the second heat exchanger 102 before passing through the first heat exchanger 101. In this case, the second heat exchanger 102 is a high-pressure side heat exchanger and the first heat exchanger 101 is a low-pressure side heat exchanger. Therefore, when the compressor 100 is in different states, the heat exchange medium may flow back to the compressor 100 along different paths, and the apparatuses for realizing refrigerating and heating functions are different, which will be convenient for users to use in different environments.

The second embodiment is illustrated in FIG. 2.

The heat exchange system 1000 includes: a first heat exchanger 101, a throttle valve 103, a second heat exchanger 102, and a compressor 100. The compressor 100, the first heat exchanger 101, the throttle valve 103 and the second heat exchanger 102 are connected successively. As shown in FIG. 2, an outlet end of the compressor 100 is connected to an inlet end of the first heat exchanger 101; an outlet end of the first heat exchanger 101 is connected to an inlet end of the throttle valve 103; an outlet end of the throttle valve 103 is connected to an inlet end of the second heat exchanger 102, that is, the throttle valve 103 is connected between the first heat exchanger 101 and the second heat exchanger 102; and an outlet end of the second heat exchanger 102 is connected to an inlet end of the compressor 100.

Thus, as shown in FIG. 2, various components of the heat exchange system 1000 are connected successively to form a closed circulation loop, and a heat exchange medium circulates in the heat exchange system 1000. The heat exchange medium is compressed into a high-pressure heat exchange medium in the compressor 100, passes through the first heat exchanger 101, the throttle valve 103 and the second heat exchanger 102 successively, and exchanges heat with the external environment in the first heat exchanger 101 and the second heat exchanger 102 to realize heating and refrigerating functions.

As shown in FIG. 2, the first valve 21 is mounted between the inlet end of the first heat exchanger 101 and the outlet end of the compressor 100, and the first valve 21 allows unidirectional communication from the compressor 100 to the first heat exchanger 101. As a result, the heat exchange medium in the compressor 100 can flow into the first heat exchanger 101, and the heat exchange medium in the first heat exchanger 101 cannot flow from the first heat exchanger 101 back into the compressor 100.

As shown in FIG. 2, the second valve 31 is mounted between the inlet end of the compressor 100 and the outlet end of the second heat exchanger 102, and the second valve 31 allows unidirectional communication from the second heat exchanger 102 to the compressor 100. As a result, the heat exchange medium in the second heat exchanger 102 can flow into the compressor 100, and the heat exchange medium in the compressor 100 cannot flow from the compressor 100 back into the second heat exchanger 102.

Moreover, when the compressor 100 stops working, the first valve 21 and the second valve 31 are each in a closed state, and the compressor 100 does not exchange the medium with the first heat exchanger 101 and the second heat exchanger 102, that is, the heat exchange medium in the compressor 100 only flows within the compressor. Due to a relatively small space inside the compressor 100, the heat exchange medium in the compressor 100 flows from its high-pressure side (the outlet end) to its low-pressure side (the inlet end), to reduce a pressure difference of the compressor 100 gradually, realize pressure balance inside the compressor 100, and meet a requirement that the pressure difference is less than 1 $kgf/cm^2$ when the compressor 100 starts. Moreover, due to the small space in the compressor 100, a final balance pressure inside the compressor 100 is relatively high, and it takes less time to reach the balance, which may allow for rapid restart.

Meanwhile, since both the first valve 21 and the second valve 31 are closed, the heat exchange medium in the first heat exchanger 101 and the second heat exchanger 102 may still utilize remaining heat or refrigeration capacity to realize corresponding heating or refrigerating functions, thereby improving overall efficiency of the heat exchange system 1000. As shown in FIG. 2, the first valve 21 and the second valve 31 are both one-way valves.

As shown in FIG. 2, an exhaust pipe 12 is arranged at the outlet end of the compressor 100, and used to be connected to an external heat exchange loop. As shown in FIG. 2, the exhaust pipe 12 is connected to the first heat exchanger 101, and the first valve 21 is mounted at the exhaust pipe 12. In this way, the heat exchange medium flows from the compressor 100 to the first heat exchanger 101 unidirectionally in the exhaust pipe 12.

As shown in FIG. 2, an intake pipe 11 is arranged at the inlet end of the liquid storage tank 4 and used to be connected to the external heat exchange loop. As shown in FIG. 2, the intake pipe 11 is connected to the second heat exchanger 102, and the second valve 31 is mounted at the intake pipe 11. In this way, the heat exchange medium flows from the second heat exchanger 102 to the compressor 100 unidirectionally in the intake pipe 11.

The third embodiment is illustrated in FIG. 3.

The heat exchange system 1000 includes a first heat exchanger 101, a throttle valve 103, a second heat exchanger 102, and a compressor 100. The compressor 100, the first heat exchanger 101, the throttle valve 103 and the second heat exchanger 102 are connected successively. As shown in FIG. 3, the compressor 100 includes a sealed container 1 and a liquid storage tank 4. An inlet end of the sealed container 1 is connected to an outlet end of the liquid storage tank 4; an outlet end of the sealed container 1 is connected to an inlet end of the first heat exchanger 101; an outlet end of the first heat exchanger 101 is connected to an inlet end of the throttle valve 103; an outlet end of the throttle valve 103 is connected to an inlet end of the second heat exchanger 102, that is, the throttle valve 103 is connected between the first heat exchanger 101 and the second heat exchanger 102; and an outlet end of the second heat exchanger 102 is connected to an inlet end of the liquid storage tank 4.

Thus, as shown in FIG. 3, various components of the heat exchange system 1000 are connected successively to form a closed circulation loop, and a heat exchange medium circulates in the heat exchange system 1000. The heat exchange medium is compressed into a high-pressure heat exchange medium in the sealed container 1, passes through the first heat exchanger 101, the throttle valve 103 and the second heat exchanger 102 successively, and exchanges heat with the external environment in the first heat exchanger 101 and the second heat exchanger 102 to realize heating and refrigerating functions.

As shown in FIG. 3, the first valve 21 is mounted between the inlet end of the first heat exchanger 101 and the outlet end of the sealed container 1, and the first valve 21 allows unidirectional communication from the sealed container 1 to the first heat exchanger 101. As a result, the heat exchange medium in the sealed container 1 can flow into the first heat exchanger 101, and the heat exchange medium in the first heat exchanger 101 cannot flow from the first heat exchanger 101 back into the sealed container 1.

As shown in FIG. 3, the second valve 31 is mounted between the inlet end of the liquid storage tank 4 and the outlet end of the second heat exchanger 102, and the second valve 31 allows unidirectional communication from the second heat exchanger 102 to the liquid storage tank 4. As a result, the heat exchange medium in the second heat exchanger 102 can flow into the liquid storage tank 4, and the heat exchange medium in the compressor 100 cannot flow from the liquid storage tank 4 back into the second heat exchanger 102.

Moreover, when the compressor 100 stops working, the first valve 21 and the second valve 31 are each in a closed state, the sealed container 1 does not exchange the medium with the first heat exchanger 101, the liquid storage tank 4 does not exchange the medium with the second heat exchanger 102, and the heat exchange medium in the compressor 100 only flows within the compressor. The heat exchange medium in the sealed container 1 has a higher pressure, while the heat exchange medium in the liquid storage tank 4 has a lower pressure. The heat exchange medium in the compressor 100 flows from its high-pressure side (the sealed container 1) to its low-pressure side (the liquid storage tank 4), so that a pressure difference of the compressor 100 gradually decreases (that is, the pressure difference between the sealed container 1 and the liquid storage tank 4 gradually decreases), to realize pressure balance inside the compressor 100, and meet a requirement that the pressure difference is less than 1 kgf/cm$^2$ when the compressor 100 starts. Moreover, due to a small space in the compressor 100, a final balance pressure inside the compressor 100 is relatively high, and it takes less time to reach the balance, which may allow for rapid restart.

Meanwhile, since both the first valve 21 and the second valve 31 are closed, the heat exchange medium in the first heat exchanger 101 and the second heat exchanger 102 may still utilize remaining heat or refrigeration capacity to realize corresponding heating or refrigerating functions, thereby improving overall efficiency of the heat exchange system 1000. As shown in FIG. 3, the first valve 21 and the second valve 31 are both one-way valves.

As shown in FIG. 3, an exhaust pipe 12 is arranged at the outlet end of the sealed container 1, and used to be connected to an external heat exchange loop. As shown in FIG. 3, the exhaust pipe 12 is connected to the first heat exchanger 101, and the first valve 21 is mounted at the exhaust pipe 12. In this way, the heat exchange medium flows from the sealed container 1 to the first heat exchanger 101 unidirectionally in the exhaust pipe 12.

As shown in FIG. 3, an intake pipe 11 is arranged at the inlet end of the liquid storage tank 4 and used to be connected to the external heat exchange loop. As shown in FIG. 3, the intake pipe 11 is connected to the second heat exchanger 102, and the second valve 31 is mounted at the intake pipe 11. In this way, the heat exchange medium flows from the second heat exchanger 102 to the liquid storage tank 4 unidirectionally in the intake pipe 11.

Moreover, as shown in FIG. 3, the heat exchange system 1000 also includes a reversing valve 104.

As shown in FIG. 3, the reversing valve 104 has a first valve port, a second valve port, a third valve port, and a fourth valve port, that is, the reversing valve 104 is a four-way valve. The first valve port is connected to the outlet end of the sealed container 1; the second valve port is connected to the inlet end of the first heat exchanger 101; the third valve port is connected to the outlet end of the second heat exchanger 102; and the fourth valve port is connected to the inlet end of the liquid storage tank 4.

The first valve port is in communication with one of the second valve port and the third valve port, and the fourth valve port is in communication with the other of the second valve port and the third valve port. As a result, when the first valve port, the second valve port, the third valve port and the fourth valve port are in different communication states, the heat exchange medium of the heat exchange system 1000 circulates along different paths.

As shown in FIG. 3, when the first valve port is in communication with the second valve port and the third valve port is in communication with the fourth valve port, the heat exchange medium flows to the first valve port of the reversing valve 104 after being pressurized in the sealed container 1, and since the first valve port is in communication with the second valve port, the heat exchange medium is discharged from the second valve port and flows to the first heat exchanger 101 (a high-pressure side heat exchanger). The heat exchange medium flows out after exchanging heat with an external medium in the first heat exchanger 101, and flows to the second heat exchanger 102. The throttle valve 103 is arranged between the first heat exchanger 101 and the second heat exchanger 102, and the flow rate of the heat exchange medium between the first heat exchanger 101 and the second heat exchanger 102 may be adjusted by controlling the throttle valve 103. The heat exchange medium exchanges heat with an external medium again in the second heat exchanger 102 (a low-pressure side heat exchanger). The heat exchange medium flows to the third valve port of the reversing valve 104 after flowing out of the second heat exchanger 102, and since the third valve port is in communication with the fourth valve port, the heat exchange medium flows from the fourth valve port to the inlet end of the liquid storage tank 4, and then flows into the sealed container 1 from the liquid storage tank 4, to proceed with the next cycle.

When the first valve port is in communication with the third valve port and the second valve port is in communication with the fourth valve port, the heat exchange medium passes through the second heat exchanger 102 before passing through the first heat exchanger 101. In this case, the second heat exchanger 102 is a high-pressure side heat exchanger and the first heat exchanger 101 is a low-pressure side heat exchanger. Therefore, when the compressor 100 is in different states, the heat exchange medium may flow back to the compressor 100 along different paths, and the apparatuses for realizing refrigerating and heating functions are different, which will be convenient for users to use in different environments.

The fourth embodiment is illustrated in FIG. 4.

The heat exchange system 1000 includes a first heat exchanger 101, a throttle valve 103, a second heat exchanger 102, and a compressor 100. The compressor 100, the first heat exchanger 101, the throttle valve 103 and the second heat exchanger 102 are connected successively. As shown in FIG. 4, the compressor 100 includes a sealed container 1 and a liquid storage tank 4. An inlet end of the sealed container 1 is connected to an outlet end of the liquid storage tank 4; an outlet end of the sealed container 1 is connected to an inlet end of the first heat exchanger 101; an outlet end of the first heat exchanger 101 is connected to an inlet end of the throttle valve 103; an outlet end of the throttle valve 103 is connected to an inlet end of the second heat exchanger 102, that is, the throttle valve 103 is connected between the first heat exchanger 101 and the second heat exchanger 102; and an outlet end of the second heat exchanger 102 is connected to an inlet end of the liquid storage tank 4.

Thus, as shown in FIG. 4, various components of the heat exchange system 1000 are connected successively to form a closed circulation loop, and a heat exchange medium circulates in the heat exchange system 1000. The heat exchange medium is compressed into a high-pressure heat exchange medium in the sealed container 1, passes through the first heat exchanger 101, the throttle valve 103 and the second heat exchanger 102 successively, and exchanges heat with the external environment in the first heat exchanger 101 and the second heat exchanger 102 to realize heating and refrigerating functions.

As shown in FIG. 4, the first valve 21 is mounted between the inlet end of the first heat exchanger 101 and the outlet end of the sealed container 1, and the first valve 21 allows unidirectional communication from the sealed container 1 to the first heat exchanger 101. As a result, the heat exchange medium in the sealed container 1 can flow into the first heat exchanger 101, and the heat exchange medium in the first heat exchanger 101 cannot flow from the first heat exchanger 101 back into the sealed container 1.

As shown in FIG. 4, the second valve 31 is mounted between the inlet end of the liquid storage tank 4 and the outlet end of the second heat exchanger 102, and the second valve 31 allows unidirectional communication from the second heat exchanger 102 to the liquid storage tank 4. As a result, the heat exchange medium in the second heat exchanger 102 can flow into the liquid storage tank 4, and the heat exchange medium in the compressor 100 cannot flow from the liquid storage tank 4 back into the second heat exchanger 102.

Moreover, when the compressor 100 stops working, the first valve 21 and the second valve 31 are each in a closed state, the sealed container 1 does not exchange the medium with the first heat exchanger 101, the liquid storage tank 4 does not exchange the medium with the second heat exchanger 102, and the heat exchange medium in the compressor 100 only flows within the compressor. The heat exchange medium in the sealed container 1 has a higher pressure, while the heat exchange medium in the liquid storage tank 4 has a lower pressure. The heat exchange medium in the compressor 100 flows from its high-pressure side (the sealed container 1) to its low-pressure side (the liquid storage tank 4), so that a pressure difference of the compressor 100 gradually decreases (that is, the pressure difference between the sealed container 1 and the liquid storage tank 4 gradually decreases), to realize pressure balance inside the compressor 100, and meet a requirement that the pressure difference is less than 1 $kgf/cm^2$ when the compressor 100 starts. Moreover, due to a small space in the compressor 100, a final balance pressure inside the compressor 100 is relatively high, and it takes less time to reach the balance, which may allow for rapid restart.

Meanwhile, since both the first valve 21 and the second valve 31 are closed, the heat exchange medium in the first heat exchanger 101 and the second heat exchanger 102 may still utilize remaining heat or refrigeration capacity to realize corresponding heating or refrigerating functions, thereby improving overall efficiency of the heat exchange system 1000. As shown in FIG. 4, the first valve 21 and the second valve 31 are both directional control valves.

As shown in FIG. 4, the first valve 21 is mounted in the first inner cavity and located at an outlet of the first inner cavity, and the heat exchange medium flows from the first inner cavity to the first heat exchanger 101 unidirectionally in the first valve 21.

As shown in FIG. 4, the second valve 31 is mounted in the second inner cavity and located at an inlet of the second inner cavity, and the heat exchange medium flows from the second heat exchanger 102 to the liquid storage tank 4 unidirectionally in the second valve 31.

Hence, the first valve 21 is mounted in the sealed container 1 and the second valve 31 is mounted in the liquid storage tank 4, so that the first valve 21 and the second valve 31 do not occupy any external space, which can reduce an installation space occupied by the overall structure of the heat exchange system 1000 and facilitate the layout of other components of the heat exchange system 1000.

The fifth embodiment is illustrated in FIG. 5.

The heat exchange system 1000 includes a first heat exchanger 101, a throttle valve 103, a second heat exchanger 102, and a compressor 100. The compressor 100, the first heat exchanger 101, the throttle valve 103 and the second heat exchanger 102 are connected successively. As shown in FIG. 5, the compressor 100 includes a sealed container 1 and a liquid storage tank 4. An inlet end of the sealed container 1 is connected to an outlet end of the liquid storage tank 4; an outlet end of the sealed container 1 is connected to an inlet end of the first heat exchanger 101; an outlet end of the first heat exchanger 101 is connected to an inlet end of the throttle valve 103; an outlet end of the throttle valve 103 is connected to an inlet end of the second heat exchanger 102, that is, the throttle valve 103 is connected between the first heat exchanger 101 and the second heat exchanger 102; and an outlet end of the second heat exchanger 102 is connected to an inlet end of the liquid storage tank 4.

Thus, as shown in FIG. 5, various components of the heat exchange system 1000 are connected successively to form a closed circulation loop, and a heat exchange medium circulates in the heat exchange system 1000. The heat exchange medium is compressed into a high-pressure heat exchange medium in the sealed container 1, passes through the first heat exchanger 101, the throttle valve 103 and the second heat exchanger 102 successively, and exchanges heat with the external environment in the first heat exchanger 101 and the second heat exchanger 102 to realize heating and refrigerating functions.

As shown in FIG. 5, the first valve 21 is mounted between the inlet end of the first heat exchanger 101 and the outlet end of the sealed container 1, and the first valve 21 allows unidirectional communication from the sealed container 1 to the first heat exchanger 101. As a result, the heat exchange medium in the sealed container 1 can flow into the first heat exchanger 101, and the heat exchange medium in the first heat exchanger 101 cannot flow from the first heat exchanger 101 back into the sealed container 1.

As shown in FIG. 5, the second valve 31 is mounted between the inlet end of the liquid storage tank 4 and the outlet end of the second heat exchanger 102, and the second valve 31 allows unidirectional communication from the second heat exchanger 102 to the liquid storage tank 4. As a result, the heat exchange medium in the second heat exchanger 102 can flow into the liquid storage tank 4, and the heat exchange medium in the compressor 100 cannot flow from the liquid storage tank 4 back into the second heat exchanger 102.

Moreover, when the compressor 100 stops working, the first valve 21 and the second valve 31 are each in a closed state, the sealed container 1 does not exchange the medium with the first heat exchanger 101, the liquid storage tank 4 does not exchange the medium with the second heat exchanger 102, and the heat exchange medium in the compressor 100 only flows within the compressor. The heat exchange medium in the sealed container 1 has a higher pressure, while the heat exchange medium in the liquid storage tank 4 has a lower pressure. The heat exchange medium in the compressor 100 flows from its high-pressure side (the sealed container 1) to its low-pressure side (the liquid storage tank 4), so that a pressure difference of the compressor 100 gradually decreases, that is, the pressure difference between the sealed container 1 and the liquid storage tank 4 gradually decreases, to realize pressure balance inside the compressor 100, and meet a requirement that the pressure difference is less than 1 $kgf/cm^2$ when the compressor 100 starts. Moreover, due to a small space in the compressor 100, a final balance pressure inside the compressor 100 is relatively high, and it takes less time to reach the balance, which may allow for rapid restart.

Meanwhile, since both the first valve 21 and the second valve 31 are closed, the heat exchange medium in the first heat exchanger 101 and the second heat exchanger 102 may still utilize remaining heat or refrigeration capacity to realize corresponding heating or refrigerating functions, thereby improving overall efficiency of the heat exchange system 1000. As shown in FIG. 5, the first valve 21 and the second valve 31 are both directional control valves.

As shown in FIG. 5, the outlet end of the liquid storage tank 4 is connected to the inlet end of the sealed container 1. The sealed container 1 has a first inner cavity, and the first valve 21 is mounted in the first inner cavity and located at an outlet of the first inner cavity. The heat exchange medium flows from the first inner cavity to the first heat exchanger 101 unidirectionally in the first valve 21.

In this way, the first valve 21 is mounted in the sealed container 1, so that the first valve 21 does not occupy any external space, which may reduce an installation space occupied by the overall structure of the heat exchange system 1000, and facilitate the layout of other components of the heat exchange system 1000.

An intake pipe 11 is arranged at the inlet end of the liquid storage tank 4 and used to be connected to an external heat exchange loop. As shown in FIG. 5, the intake pipe 11 is connected to the second heat exchanger 102, and the second valve 31 is mounted at the intake pipe 11. In this way, the heat exchange medium flows from the second heat exchanger 102 to the liquid storage tank 4 unidirectionally in the intake pipe 11.

Figure 6:
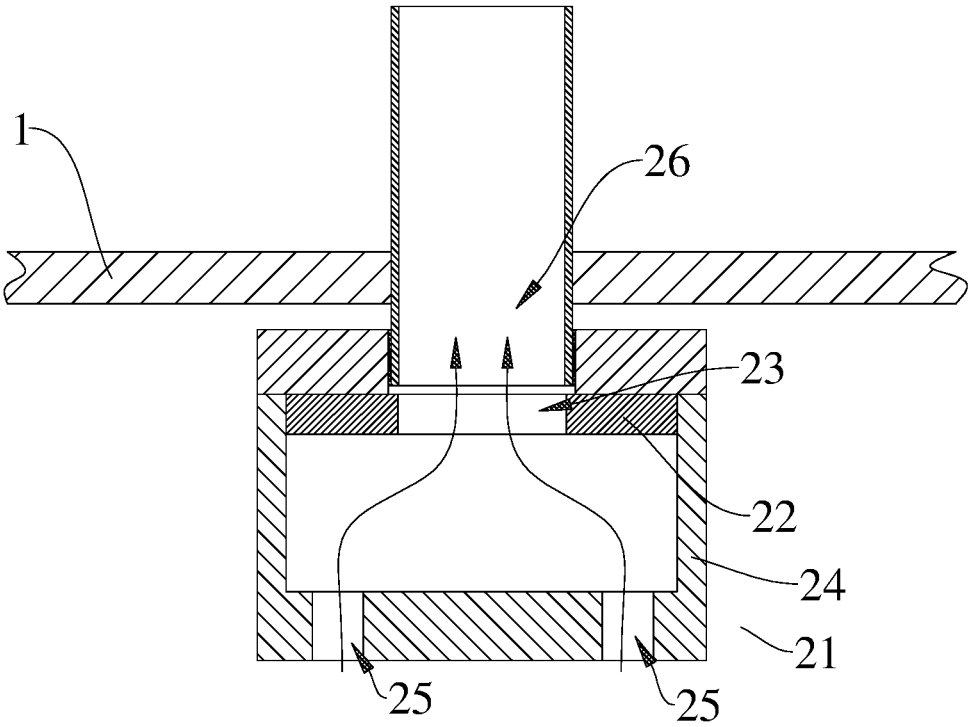
FIG. 6 is a sectional view of a first valve of the compressor according to the above embodiments of the present disclosure (when the compressor is working)
Figure 7:
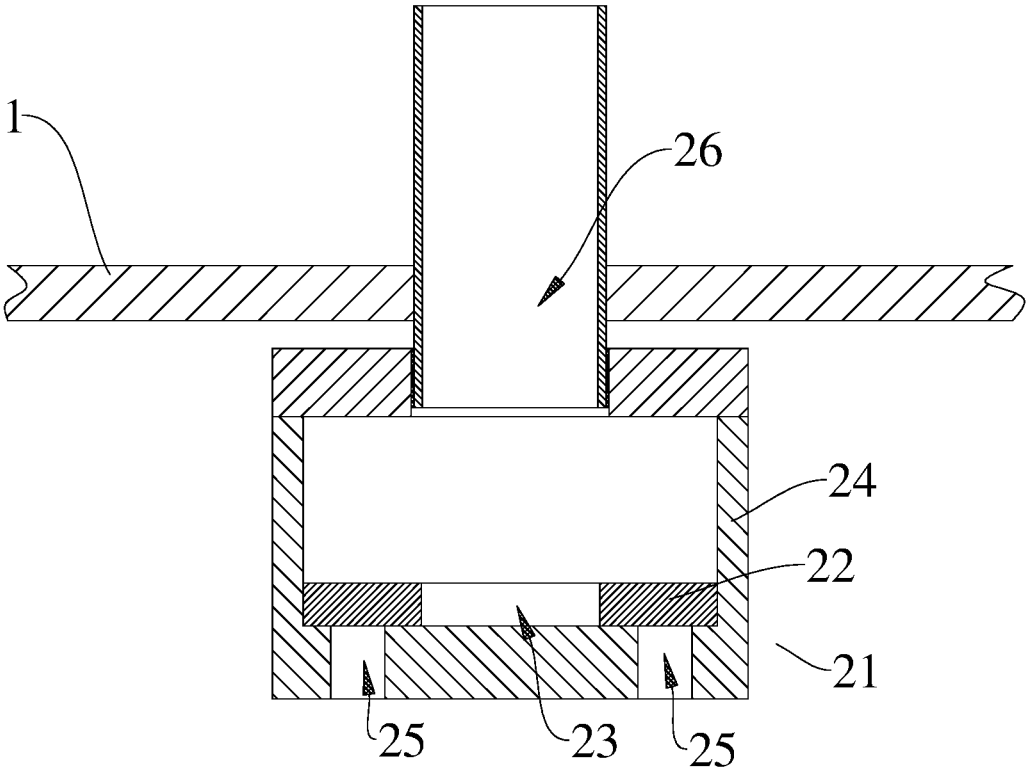
FIG. 7 is a sectional view of the first valve of the compressor according to the above embodiments of the present disclosure (when the compressor stops working)
Figure 8:
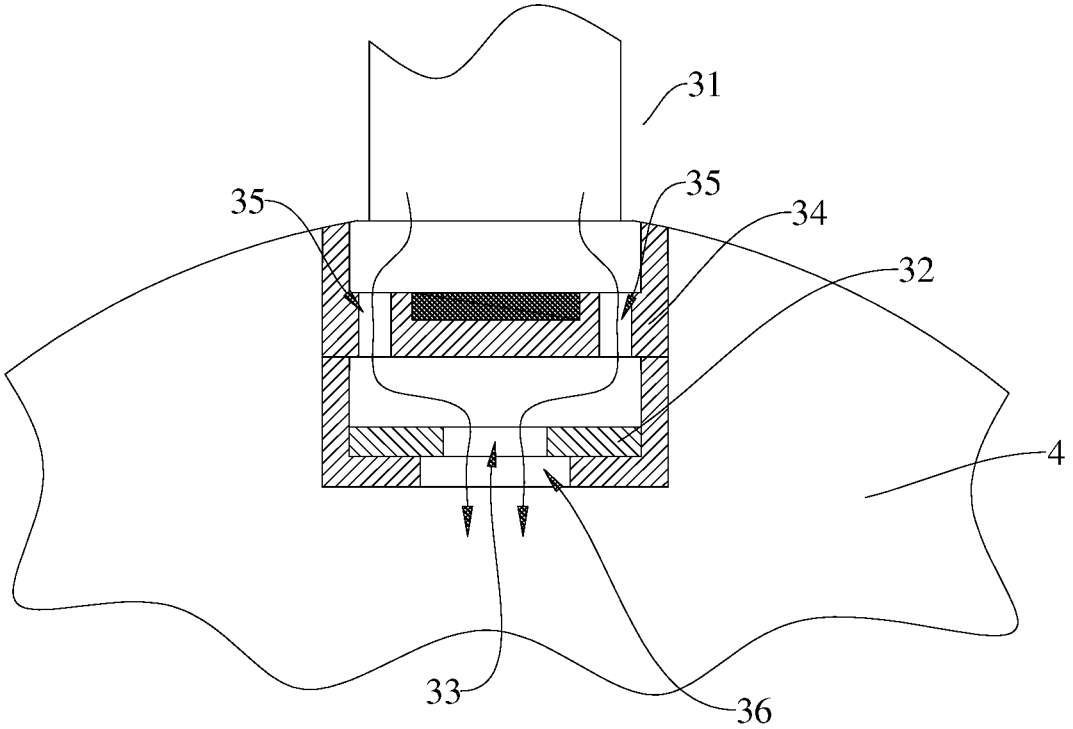
FIG. 8 is a sectional view of a second valve of the compressor according to the embodiments of the present disclosure (when the compressor is working)
Figure 9:
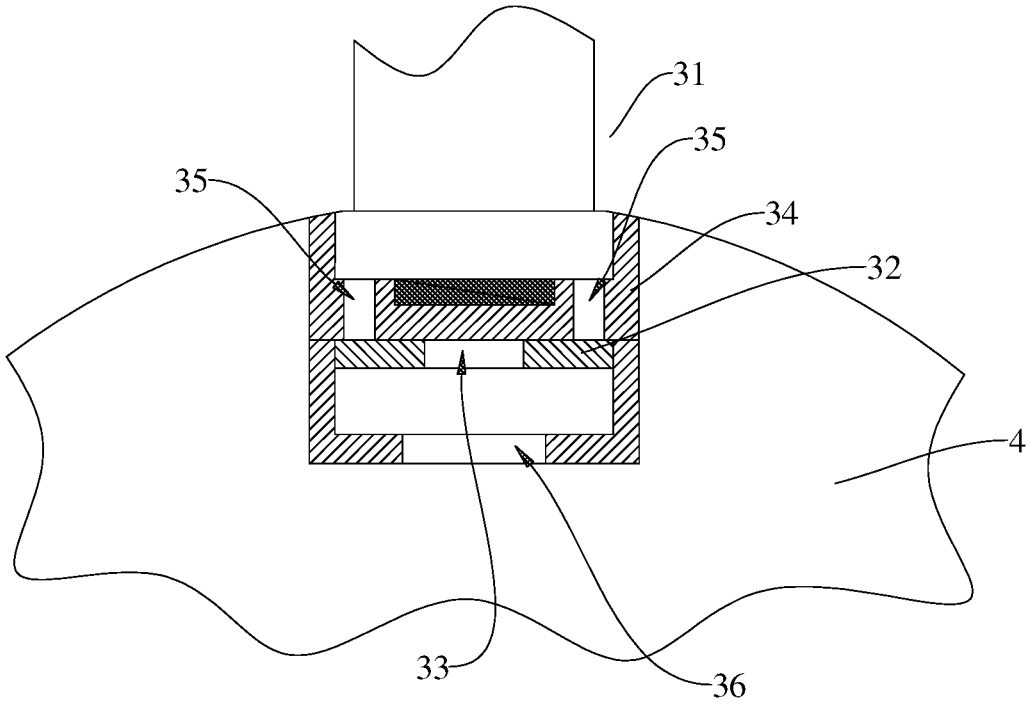
FIG. 9 is a sectional view of the second valve of the compressor according to the embodiments of the present disclosure (when the compressor stops working)

FIGS. 6 and 7 are sectional views of the first valve 21 of the compressor, respectively. FIGS. 8 and 9 are sectional views of the first valve 21 of the compressor, respectively.

As shown in FIGS. 6 and 7, the first valve 21 is mounted between the inlet end of the first heat exchanger 101 and the outlet end of the sealed container 1, and the first valve 21 allows unidirectional communication from the sealed container 1 to the first heat exchanger 101. As a result, the heat exchange medium in the sealed container 1 can flow into the first heat exchanger 101, and the heat exchange medium in the first heat exchanger 101 cannot flow from the first heat exchanger 101 back into the sealed container 1.

As shown in FIGS. 8 and 9, the second valve 31 is mounted in the liquid storage tank 4, and the second valve 31 allows unidirectional communication from the inlet end of the liquid storage tank 4 to the outlet end of the liquid storage tank 4. As a result, the heat exchange medium at the inlet end of the liquid storage tank 4 can flow to the outlet end of the liquid storage tank 4, and the heat exchange medium at the outlet end of the liquid storage tank 4 cannot flow back to the inlet end of the liquid storage tank 4.

Moreover, when the compressor 100 stops working, the first valve 21 and the second valve 31 are each in a closed state, the sealed container 1 does not exchange the medium with the first heat exchanger 101, the liquid storage tank 4 does not exchange the medium with the second heat exchanger 102, and the heat exchange medium in the compressor 100 only flows within the compressor. The heat exchange medium in the sealed container 1 has a higher pressure, while the heat exchange medium in the liquid storage tank 4 has a lower pressure. The heat exchange medium in the compressor 100 flows from its high-pressure side (the sealed container 1) to its low-pressure side (the liquid storage tank 4), so that a pressure difference of the compressor 100 gradually decreases, that is, the pressure difference between the sealed container 1 and the liquid storage tank 4 gradually decreases, to realize pressure balance inside the compressor 100, and meet a requirement that the pressure difference is less than 1 $kgf/cm^2$ when the compressor 100 starts. Moreover, due to a small space in the compressor 100, a final balance pressure inside the compressor 100 is relatively high, and it takes less time to reach the balance, which may allow for rapid restart.

Meanwhile, since both the first valve 21 and the second valve 31 are closed, the heat exchange medium in the first heat exchanger 101 and the second heat exchanger 102 may still utilize remaining heat or refrigeration capacity to realize corresponding heating or refrigerating functions, thereby improving overall efficiency of the heat exchange system 1000. As shown in FIGS. 6-9, the first valve 21 and the second valve 31 are both directional control valves.

As shown in FIG. 7, the first valve 21 is mounted in the first inner cavity and located at an outlet of the first inner cavity, and the heat exchange medium flows from the first inner cavity to the first heat exchanger 101 unidirectionally in the first valve 21.

As shown in FIG. 9, the second valve 31 is mounted in the second inner cavity, and the second valve 31 is spaced from an inlet and an outlet of the second inner cavity. The heat exchange medium flows from the inlet of the second inner cavity to the outlet of the second inner cavity unidirectionally in the second valve 31.

Hence, the first valve 21 is mounted in the sealed container 1 and the second valve 31 is mounted in the liquid storage tank 4, so that the first valve 21 and the second valve 31 do not occupy any external space, which can reduce an installation space occupied by the overall structure of the heat exchange system 1000 and facilitate the layout of other components of the heat exchange system 1000.

Figure 10:
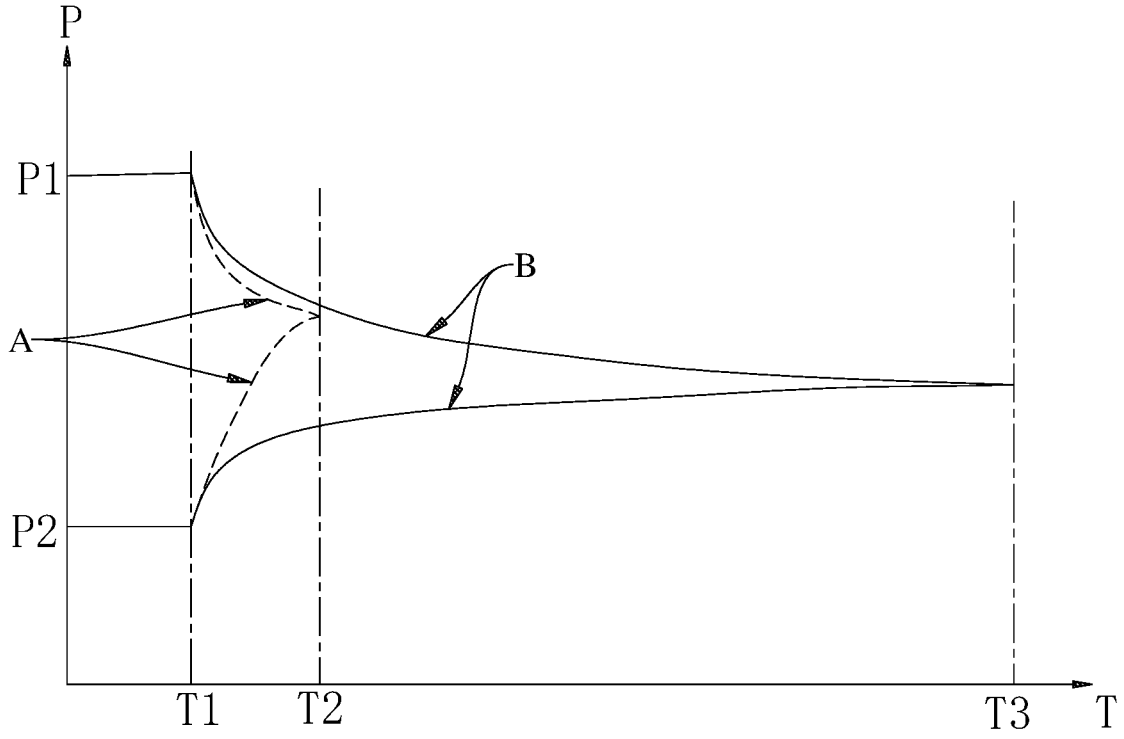
FIG. 10 is a schematic view illustrating changes in internal pressure over time of the compressor according to the embodiments of the present disclosure and a compressor in the related art.

As shown in FIG. 10, through tests, the first valve and the second valve in the present disclosure are arranged at the outlet end and inlet end of the compressor, respectively, so that it takes less time to reach the pressure balance, and the pressure in the liquid storage tank 4 increases rapidly while the pressure in the sealed container decreases rapidly. Moreover, the final balance pressure is relatively high, which is convenient to meet the requirement of rapid restart of the compressor.

In contrast, it will take longer time for the compressor that is not provided with the first valve and the second valve in the related art to reach the pressure balance. The pressure in the liquid storage tank 4 increases slowly while the pressure in the sealed container decreases slowly, and the final balance pressure is relatively low, which is not conducive to the rapid restart of the compressor.

As shown in FIG. 10, the compressor stops working at time T1, the pressure in the sealed container is P1, and the pressure in the liquid storage tank 4 is P2. The compressor according to the present disclosure realizes the pressure balance at time T2, but the compressor in the related art realizes the pressure balance at time T3. Moreover, a difference value between T3 and T1 is far greater than a difference value between T2 and T1. As shown in FIG. 10, the pressure of the compressor in the present disclosure at time T2 is greater than the pressure of the compressor in the related art at time T3, which indicates that the compressor in the present disclosure is conducive to realizing the pressure balance quickly. The dotted line A indicates an internal pressure change of the compressor in the present disclosure, and the solid line B indicates an internal pressure change of the compressor in the related art.

A compressor according to embodiments of the present disclosure includes: a sealed container and a liquid storage tank, in which an outlet end of the liquid storage tank is connected to an inlet end of the sealed container, and an outlet end of the sealed container and an inlet end of the liquid storage tank are connected to an external heat exchange loop; a motor and a compression mechanism, both mounted in the sealed container; a first valve and a second valve, in which the first valve is mounted at the outlet end of the sealed container and allows unidirectional communication from the sealed container to the external heat exchange loop, and the second valve is mounted at the inlet end of the liquid storage tank and allows unidirectional communication from the external heat exchange loop to the liquid storage tank.

For the compressor according to the embodiments of the present disclosure, the first valve and the second valve are arranged at the inlet end and the outlet end of the compressor, respectively, and both the first valve and the second valve are in the closed state after the compressor stops working, so that the heat exchange medium realizes the pressure balance within the compressor, and it takes less time to reach the pressure balance, which can meet the requirement of rapid restart; moreover, the heat exchange medium in the external heat exchange loop cannot flow back, and the residual heat may be effectively utilized.

In the compressor according to an embodiment of the present disclosure, an exhaust pipe is arranged at the outlet end of the sealed container and connected to the external heat exchange loop, and the first valve is mounted at the exhaust pipe; and an intake pipe is arranged at the inlet end of the liquid storage tank and connected to the external heat exchange loop, and the second valve is mounted at the intake pipe.

In the compressor according to an embodiment of the present disclosure, the sealed container has a first inner cavity, and the liquid storage tank has a second inner cavity, in which the first valve is mounted in the first inner cavity and located at an outlet of the first inner cavity, and the second valve is mounted in the second inner cavity and located at an inlet of the second inner cavity.

In the compressor according to an embodiment of the present disclosure, the sealed container has a first inner cavity, and the liquid storage tank has a second inner cavity, in which the first valve is mounted in the first inner cavity and located at an outlet of the first inner cavity, and the second valve is mounted in the second inner cavity and spaced from an inlet and an outlet of the second inner cavity.

In the compressor according to an embodiment of the present disclosure, the sealed container has a first inner cavity, and the first valve is mounted in the first inner cavity; an intake pipe is arranged at the inlet end of the liquid storage tank and connected to the external heat exchange loop, and the second valve is mounted at the intake pipe.

In the compressor according to an embodiment of the present disclosure, an exhaust pipe is arranged at the outlet end of the sealed container and connected to the external heat exchange loop, and the first valve is mounted at the exhaust pipe; the liquid storage tank has a second inner cavity, and the second valve is mounted in the second inner cavity and located at an inlet of the second inner cavity.

In the compressor according to an embodiment of the present disclosure, at least one of the first valve and the second valve is a one-way valve.

In the compressor according to an embodiment of the present disclosure, at least one of the first valve and the second valve is a directional control valve.

In the compressor according to an embodiment of the present disclosure, at least one of the first valve and the second valve is a switch valve.

The present disclosure also provides a heat exchange system.

The heat exchange system according to embodiments of the present disclosure includes: a first heat exchanger, a throttle valve, a second heat exchanger, and the compressor according to any one of the above embodiments. The first valve is mounted between an inlet end of the first heat exchanger and an outlet end of the sealed container and allows unidirectional communication from the sealed container to the first heat exchanger; the throttle valve is connected between an outlet end of the first heat exchanger and an inlet end of the second heat exchanger; and the second valve is mounted between an inlet end of the liquid storage tank and an outlet end of the second heat exchanger and allows unidirectional communication from the second heat exchanger to the liquid storage tank.

The heat exchange system according to an embodiment of the present disclosure also includes a reversing valve, and the reversing valve has a first valve port, a second valve port, a third valve port and a fourth valve port, in which the first valve port is in communication with the first valve; the second valve port is in communication with the inlet end of the first heat exchanger; the third valve port is in communication with the outlet end of the second heat exchanger; the fourth valve port is in communication with the second valve; and the first valve port is in communication with one of the second valve port and the third valve port, while the fourth valve port is in communication with the other of the second valve port and the third valve port.

Reference throughout this specification to "an embodiment," "some embodiments," "an exemplary embodiment", "an example," "a specific example," or "some examples," means that a particular feature, structure, material, or characteristic described in connection with the embodiment or example is included in at least one embodiment or example of the present disclosure. Thus, the appearances of the above terms in various places throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it would be appreciated by those skilled in the art that changes, modifications, alternatives and variants can be made to these embodiments without departing from the principle and purpose of the present disclosure. The scope of the present disclosure is limited by claims and their equivalents.

What is claimed is:

1. A compressor comprising:

a sealed container and a fluid storage tank configured to hold a heat exchange medium, wherein an outlet end of the fluid storage tank is connected to an inlet end of the sealed container, and an outlet end of the sealed container and an inlet end of the fluid storage tank are configured to be connected to an external heat exchange loop;

a motor and a compression mechanism configured to compress the heat exchange medium, both mounted in the sealed container; and a first valve and a second valve, wherein:

the first valve is mounted at the outlet end of the sealed container and allows unidirectional communication of the heat exchange medium from the sealed container to the external heat exchange loop, the second valve is mounted at the inlet end of the fluid storage tank and allows unidirectional communication of the heat exchange medium from the external heat exchange loop to the fluid storage tank, and the first and second valves are configured to, when closed, disconnect the compressor from the external heat exchange loop such that the heat exchange medium:

cannot flow to and from the compressor;

cannot flow to and from the external heat exchange loop; and can flow between a high-pressure side of the sealed container and the fluid storage tank to balance pressure of the heat exchange medium within the compressor.

2. The compressor according to claim 1, wherein:

an exhaust pipe is arranged at the outlet end of the sealed container and connected to the external heat exchange loop;

the first valve is mounted at the exhaust pipe;

an intake pipe is arranged at the inlet end of the fluid storage tank and connected to the external heat exchange loop; and the second valve is mounted at the intake pipe.

3. The compressor according to claim 1, wherein:

the sealed container has a first inner cavity corresponding to the high-pressure side; and the fluid storage tank has a second inner cavity that communicates with the fluid storage tank.

4. The compressor according to claim 1, wherein:

the sealed container has a first inner cavity corresponding to the high-pressure side;

the first valve is mounted in the first inner cavity;

an intake pipe is arranged at the inlet end of the fluid storage tank and connected to the external heat exchange loop; and the second valve is mounted at the intake pipe.

5. The compressor according to claim 1, wherein:

an exhaust pipe is arranged at the outlet end of the sealed container and connected to the external heat exchange loop;

the first valve is mounted at the exhaust pipe;

the fluid storage tank has a second inner cavity; and the second valve is mounted in the second inner cavity and located proximate an inlet of the second inner cavity.

6. The compressor according to claim 1, wherein at least one of the first valve and the second valve comprises a one-way valve.

7. The compressor according to claim 1, wherein at least one of the first valve and the second valve comprises a directional control valve.

8. The compressor according to claim 1, wherein at least one of the first valve and the second valve comprises a switch valve.

9. A heat exchange system comprising:

the external heat exchange loop comprising a first heat exchanger, a throttle valve, and a second heat exchanger, and the compressor according to claim 1, wherein:

the first valve is mounted between an inlet end of the first heat exchanger and an outlet end of the sealed container and allows unidirectional communication of the heat exchange medium from the sealed container to the first heat exchanger;

the throttle valve is connected between an outlet end of the first heat exchanger and an inlet end of the second heat exchanger; and the second valve is mounted between an inlet end of the fluid storage tank and an outlet end of the second heat exchanger and allows unidirectional communication of the heat exchange medium from the second heat exchanger to the fluid storage tank.

10. The heat exchange system according to claim 9, further comprising:

a reversing valve configured to direct the heat exchange medium, wherein the reversing valve has a first valve port, a second valve port, a third valve port and a fourth valve port, wherein the first valve port is in communication with the first valve; the second valve port is in communication with the inlet end of the first heat exchanger; the third valve port is in communication with the outlet end of the second heat exchanger; and the fourth valve port is in communication with the second valve, and wherein the first valve port is in communication with one of the second valve port and the third valve port, and the fourth valve port is in communication with the other of the second valve port and the third valve port.

11. The compressor according to claim 1, wherein the first valve is on the high-pressure side of the compressor.

12. A heat exchange system comprising:

an external heat exchange loop comprising:

an external heat exchange loop inlet; and an external heat exchange loop outlet a sealed container comprising:

a motor;

a compression mechanism attached to the motor;

a low-pressure side including a sealed container inlet; and a high-pressure side including a sealed container outlet;

a fluid storage tank comprising:

a fluid storage tank inlet; and a fluid storage tank outlet connected to the sealed container inlet;

a first valve disposed between the sealed container outlet and the external heat exchange loop inlet, wherein the first valve is configured to allow for unidirectional communication of a heat exchange medium of the heat exchange system from the sealed container outlet to the external heat exchange loop inlet; and a second valve disposed between the fluid storage tank inlet and the external heat exchange loop outlet, wherein the second valve is configured to allow for unidirectional communication of the heat exchange medium from the external heat exchange loop outlet to the fluid storage tank inlet, wherein the first valve and the second valve are configured to, when closed, disconnect the sealed container and the fluid storage tank from the external heat exchange loop such that the heat exchange medium:

cannot flow from the external heat exchange loop inlet to the sealed container outlet;

cannot flow from the fluid storage tank inlet to the external heat exchange loop outlet;

cannot flow between the external heat exchange loop inlet and the external heat exchange loop outlet; and can flow between the high-pressure side of the sealed container and the low- pressure side of the sealed container and the fluid storage tank to balance pressure of the heat exchange medium between the high-pressure side of the sealed container and the low-pressure side of the sealed container and the fluid storage tank.

* * * * *